US007310850B2

(12) United States Patent
Ge

(10) Patent No.: US 7,310,850 B2
(45) Date of Patent: Dec. 25, 2007

(54) IN-BETWEEN TOE MASSAGER OR CLEANER WITH SPATULATE EXTENSIONS

(76) Inventor: Jack Hu Ge, 721 Arcadia Ave., Arcadia, CA (US) 91007

( * ) Notice: Subject to any disclaimer, the term of this patent is extended or adjusted under 35 U.S.C. 154(b) by 138 days.

(21) Appl. No.: 11/249,878

(22) Filed: Oct. 13, 2005

(65) Prior Publication Data

US 2006/0130258 A1 Jun. 22, 2006

Related U.S. Application Data

(63) Continuation-in-part of application No. 11/013,730, filed on Dec. 17, 2004.

(51) Int. Cl.
*A47K 7/02* (2006.01)
*A47K 7/04* (2006.01)

(52) U.S. Cl. ..... 15/210.1; 15/111; 601/137

(58) Field of Classification Search ..... 15/104.94, 15/210.1, 220.3, 229.11, 229.13, 236.06, 15/111; 601/137
See application file for complete search history.

(56) References Cited

U.S. PATENT DOCUMENTS 1,623,124 A * 4/1927 Laufe ..... 601/135
2,134,965 A * 11/1938 Zbarsky ..... 15/220.3
2,856,625 A * 10/1958 Delacretaz ..... 15/244.1
3,429,309 A * 2/1969 Kurth et al. ..... 602/30
3,531,814 A * 10/1970 Safalow ..... 15/114
4,520,525 A 6/1985 Yogi et al.
4,718,141 A * 1/1988 Kuehnl ..... 15/394
4,961,733 A * 10/1990 Joseph et al. ..... 604/293
5,500,971 A * 3/1996 Springmann ..... 15/23
5,704,089 A * 1/1998 Walters ..... 15/227
D398,155 S * 9/1998 LaTour et al. ..... D4/116
5,813,078 A 9/1998 Hogan, Sr.
5,970,565 A * 10/1999 Dubner ..... 15/210.1
6,213,963 B1 * 4/2001 Smith ..... 601/104

FOREIGN PATENT DOCUMENTS

JP 11-127959 * 5/1999

* cited by examiner

*Primary Examiner*—Randall Chin

(57) ABSTRACT

The present invention is a handheld and highly mobile device with paddle extensions adapted to be comfortably inserted at the same time between a user's toes. The paddle extensions can be moved in an up and down sliding motion for massage or cleaning of inter-toe surfaces. The paddle extensions provide massage in one embodiment and scrubbing or cleansing in another embodiment. In a cleansing embodiment, the invention device incorporates a readily cleaned or disposable glove that form-fits over the paddles. The glove is made of absorbent material with a smooth to coarse outside surface to facilitate cleaning and/or scrubbing.

3 Claims, 5 Drawing Sheets

IN-BETWEEN TOE MASSAGER OR CLEANER WITH SPATULATE EXTENSIONS

This application is a continuation in part of Ser. No. 11/013,730 filed Dec. 17, 2004, now pending.

FIELD OF THE INVENTION

The invention relates to a device for cleaning between a human user's toes. More particularly, the invention relates to such a scrubbing device capable of being easily cleaned and stored.

BACKGROUND OF THE INVENTION

One of the most neglected areas of the body, in terms of personal hygiene, is the surfaces between the toes of a person's feet. Because of the inconvenience of reaching them while showering or bathing, many people fail to properly cleanse the inter-toe surfaces, thus resulting in numerous fungal diseases, as well as discomfort, to the feet.

Many people find it difficult to effectively clean their inter-toe surfaces while taking a shower or bath. To wash one's inter-toe surfaces properly in a shower, it is necessary to stand on one foot and can be quite dangerous. It is possible to end up slipping and falling as a result of trying to so clean inter-toe surfaces. Most persons would prefer to deal with fungal infection than tolerate that risk. There has been a long recognized need for a device that can easily and comfortably clean the surfaces between a user's toes.

U.S. Pat. No. 5,813,078 describes a shower foot washer. The device is a suction cup attached platform supporting an open ended box. Towards the open ended side of the box are a number of dividers or partitions with bristled leading edges. These leading edges are separated in a way that allows a user to scrub between their toes while in a shower. The device is without benefit outside of a shower. A stream of water and soap from outside the box must be delivered to the user's toes to provide washing facilitated by the bristled leading edges. Outside of a showering water stream from above that then drains from the bristles, the device provides little cleansing action.

U.S. Pat. No. 4,520,525 describes what amounts to a bathtub version of the '078 patent. A box is divided in two to receive a user's feet, each divided section further divided with bristled partitions for scrubbing between a user's toes. The device is quite large and, in contrast to its intended purpose, difficult to clean or sanitize. The prior art devices for scrubbing between a user's toes appear to have met with very limited commercial interest because of their size and difficulty in cleaning and storing. There is a need for a device that overcomes these aspects of prior art devices.

SUMMARY OF THE INVENTION

The present invention is a handheld and highly mobile device with paddle extensions adapted to be comfortably inserted at the same time between a user's toes. The paddle extensions can be moved in an up and down sliding motion for massage or cleaning of inter-toe surfaces. The paddle extensions provide massage in one embodiment and scrubbing or cleansing in another embodiment. In a cleansing embodiment, the invention device incorporates a readily cleaned or disposable glove that form-fits over the paddles. The glove is made of absorbent material with a smooth to coarse outside surface to facilitate cleaning and/or scrubbing.

In general, the invention device comprises a handle adapted to be handheld at one end and attached to a paddle supporting body at another end. In a preferred embodiment, the handle is removable from the paddle supporting body. The paddle supporting body supports four parallel paddles adapted to be inserted between a user's toes. The surface texture, composition, dimensions, and spacing of the paddles are the subject of specific embodiments described below.

In one form, the invention comprises a single outside paddle wider than the other three to be inserted into the inter-toe space between the big toe and its adjacent toe.

In another form of the invention, the paddles are formed of a sufficiently stiff polymer rubber or foamed rubber so that a user experiences a pleasant sensation when the paddles are move back and forth in their inter-toe spaces.

In another form of the invention, the paddles' opposing surfaces are undulating or comprise bumps or peaks and valleys to provide a massaging surface when moved back and forth across a user's inter-toe surfaces.

In the glove-type embodiments of the invention, the glove can be made of one of a range of materials and or surface textures depending on the intended use of the invention device. A relatively smooth and thin absorbent material (such as a single layer of cotton fabric or gauze) is used to lightly cleanse or apply essential or massage oils to the inter-toe surfaces. A soft, raised surface can be incorporated into the glove if is formed from terrycloth, a material well known in washcloths and towels. The terrycloth glove can be used to absorb soap and water which is then applied gently or vigorously to the inter-toe surfaces. The terrycloth glove can alternately be used as a highly effective cleaning means, i.e., for tar or treatment of fungal infection between the toes, the terrycloth surface can respectively carry a solvent or medication and both apply the remedial material as well as carry away undesirable materials. Further, the glove can be formed from a cotton or polymer fabric and bear short bristles or a similar scrubbing surface for cleaning the inter-toe surfaces more deeply. The glove is adapted to be pulled on and off the paddles in the same manner as a human would apply or remove a glove from their hand. The glove is adapted to be tied or secured to the paddle supporting body or handle to prevent its become dislodged during use.

It is an object of the invention to provide a handheld device for cleaning or massaging inter-toe surfaces.

It is an object of the invention to provide a set of four parallel paddles supporting a glove covering and adapted to comfortably be inserted between a user's toes to clean or apply materials to inter-toe surfaces.

It is an object of the invention to provide a device with a set of four parallel paddles formed substantially of a yielding but structurally stiff polymer foamed rubber which is further adapted to comfortably be inserted between a user's toes for sliding back and forth to accomplish a massage function. It has been found that this form of inter-toe massage has substantial benefits for a user and improves blood flow and muscle relaxation thereat.

The present invention also includes a variable width embodiment of the paddle extensions. In this embodiment, one to four paddle extensions extend downward and away from a paddle supporting body. A first paddle extension comprises two wide width sections separated by a narrow width section. A second paddle extension comprises two narrow width sections separated by a wide width section. Adjacent paddle extensions alternate between first and second paddle extensions. Thus, the first and second paddle extensions are spaced apart in a parallel arrangement by the width of a human toe and are adjacently fixed to the paddle supporting body. In this structure, wide width sections of one paddle extension are always opposite narrow width sections of an adjacent paddle extension. Consequently, narrow width sections of one paddle extension are always opposite wide width sections of an adjacent paddle extension.

An individual paddle extension with variable width sections has been found to dramatically improve the cleaning and massage abilities of said paddle extension. It is well known that human toes are urged together in their side by side alignment. This is at least in part due to modern human's use of closed toe shoes which cause the toes and musculature to grow into a compact and crowded anatomical arrangement. As such, there is almost no inter-toe space when a person's toes are in a relaxed position. The present embodiment achieves in improvement in inter-toe cleansing and massage.

Consider the paddle extension with two wide-width sections is to be moved up and down between almost non-existent inter-toe space. In such a case, a leading wide width section cleanses or massages adjacent toes to a greatest degree with increased surface area and is followed by a narrow width section that allows the adjacent toes to partly relax together. As a final wide width section moves into the inter-toe space, the toes are once again moved apart to a greatest degree.

Consider the paddle extension with two narrow-width sections is to be moved up and down between almost non-existent inter-toe space. In such a case, a leading narrow width section cleanses or massages adjacent toes to a lesser degree with reduced surface area and is followed by a wide width section that moves the adjacent toes apart more than the narrow width section. As a final narrow width section moves into the inter-toe space, the toes are once again allowed to partly relax together.

The present embodiment with two or more paddle extensions thereby moves into adjacent inter-toe spaces (i.e., of three adjacent toes) a narrow width section in one inter-toe space and a wide width section into a second inter-toe space. The set of three toes effectively massaged in a side to side swaying motion as alternating narrow and wide width sections on adjacent paddle extensions are moved into the adjacent inter-toe spaces. The present embodiment comprises one to four such paddle extensions. A user may desire to massage or cleanse fewer than all a user's inter-toe spaces.

The present embodiment provides the user with a flexible approach to inter-toe massage or cleansing. A user may have fungal infection between only one inter-toe space and not want to risk spreading it by using a multi-paddle device. In the present embodiment, a single removable handle can be provided with one to four pieces, where the respectively comprise one to four of this embodiment's paddle extensions from a paddle support body adapted to be fixed to the handle. Because of the low cost of the separate pieces, a single kit can be formed and sold to the user comprising a handle and one or more of the separate pieces.

DETAILED DESCRIPTION OF THE INVENTION

The invention is now discussed with reference to the figures.

Figure 1:
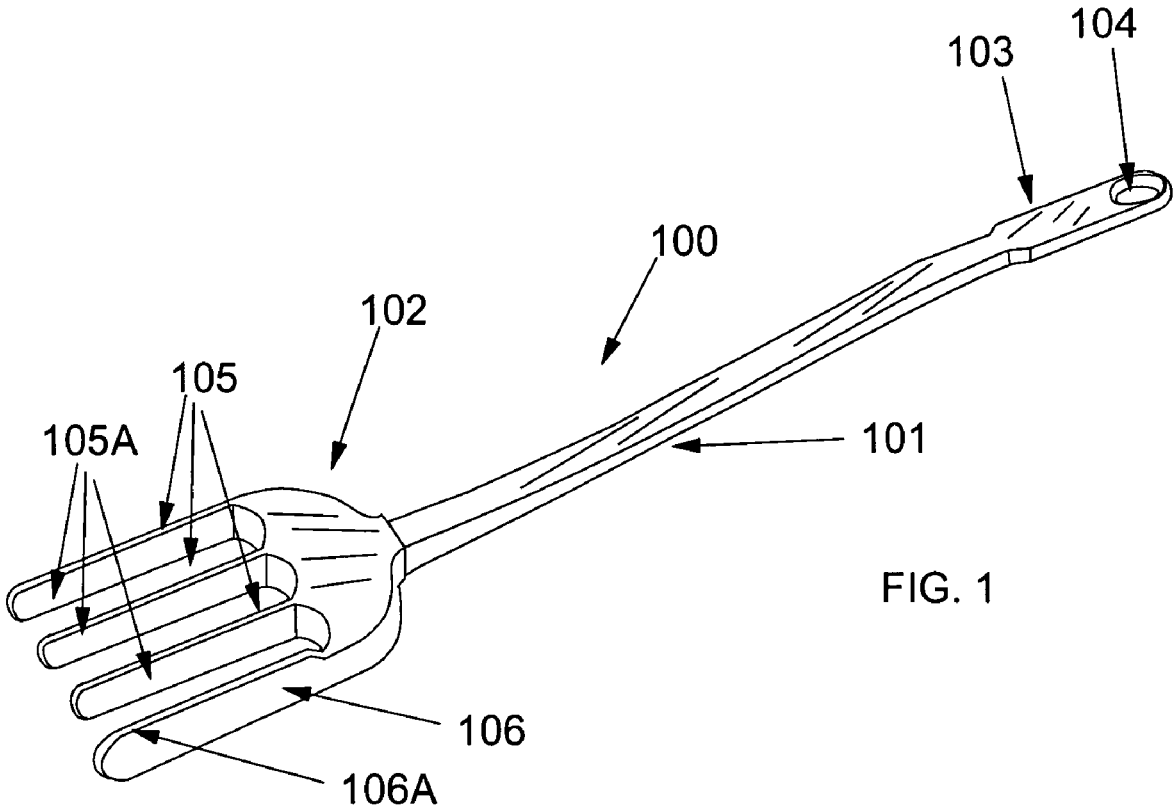
FIG. 1 is a perspective view of the invention device.

FIG. 1 shows that inter-toe device 100 comprises a handle 101 attached to a paddle supporting body 102, wherefrom paddles 107 and 108 extend parallel to each other. Handle 101 comprises a hand held part 103 with an optional hanging hole 104. Handle 101 extends from part 103 to a shaft ending in a connection to the paddle supporting body 102. Paddle supporting body 102 extends from its connection with the handle 101 to support of paddles 105 and 106. Paddles 105 and 106 have a thickness of about no more than 5-7 millimeters, and preferably in the range of from 1 to 5 millimeters.

A user's toes are usually of uniform width. Although not all different user's toes are the same width, toe widths for most humans are surprisingly uniform where obesity or edema has not intruded. Separation of the paddles is preferably around 10 to 20 millimeters for adults and proportionately less for children and infants. Paddles 105 and 106 are preferably formed integral with paddle supporting body 102 for rigid support therefrom. Paddles 105 preferably have a uniform width and length and are secured parallel to each other so that their leading edges 105A lie substantially in the same plane, but are generally adapted to comfortably be inserted between a user's toes and move in an up and down motion as in directions 110 shown in FIG. 2. Paddle 106 has a thickness and length substantially the same as paddles 105 and are parallel to them. However, the width of paddle 106 is in one form of the invention substantially greater than that of paddles 105. Paddle 106 is optionally adapted to be inserted in the space between the big toe and its adjacent toe. In order for a leading edge 106A to reach the vertex base of that space (i.e., the base of each adjacent toe), it should extend farther in a forward direction and out of the plane formed by leading edges 105A. So paddle 106 is preferably wider than paddles 105 so that its leading edges 106A (on both sides of device 100) extend beyond the plane formed by leading edges 105A of paddles 105. Leading edges 106A extend more widely than the leading edges 105A on both sides of device 100 so that it can be rotated for use on the toes of both feet to accomplish the same cleaning and massaging functions along the entire lengths of the big toe and its adjacent toe in the same manner that paddles 105 accomplish the same function. In a preferred embodiment, the alignment of leading edges 105A and 106A are critical to the use of the invention device where reaching the entire lengths of inter-toe surfaces is important. In cleansing for removal of tar or other contaminants or in application of antifungal medication, such complete reach of the paddles 105 and 106 is important.

Figure 2:
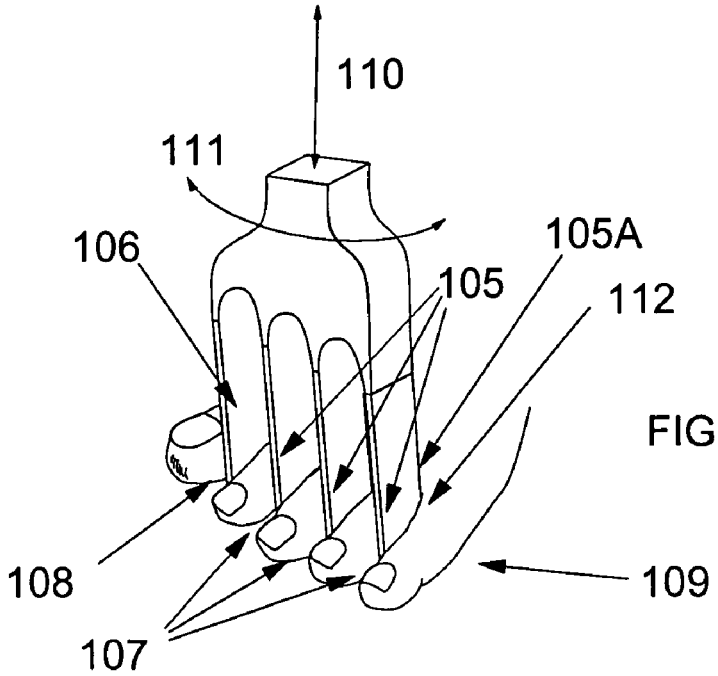
FIG. 2 is a perspective view of the paddle supporting body and paddles, with the paddles inserted between a user's toes.

FIG. 2 shows that paddles 105 and 106 can be moved up and down in direction 110 to accomplish the objects of the invention. A user's foot 109 comprises smaller toes 107 and big toe 108. As an example of the reach of the width of the paddles into the inter-toe spaces, a nearest paddle 105 with leading edge 105A reaches the joining vertex 112 of the little toe and its adjacent toe. FIG. 2 shows that device 100 may be rotated in directions 111 to apply greater or lesser force at paddle 106 or a lateral end paddle 105.

Figure 3:
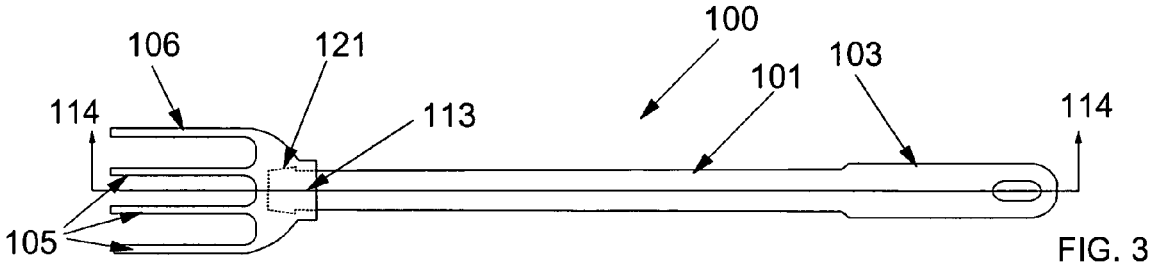
FIG. 3 is a top view of the invention device.
Figure 4:
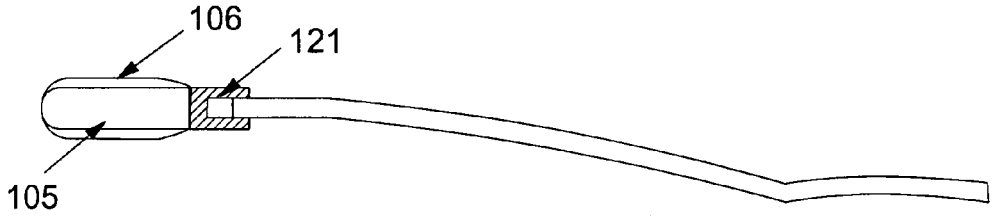
FIG. 4 is a side cross section 114 view of the device of FIG. 3.
Figure 5:
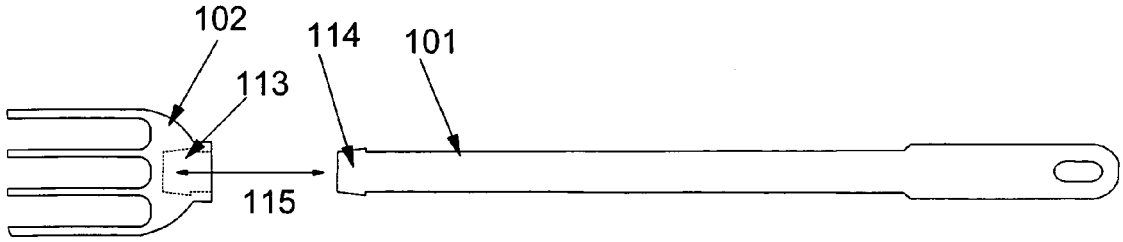
FIG. 5 is the device of FIG. 3 showing the handle separated from the paddle supporting body.

FIGS. 3, 4 and 5 show that device 100 can be made with a detachable paddle supporting body 102 This can be critical to use of this device among several users. Most humans have very little chance of contaminating even a close living partner with their inter-toe fungus or bacteria. However, use of the invention device could cause such inter-partner contamination. To prevent that from happening, each user of the invention device 100 can maintain their own paddle supporting body 102 or remove it to sanitize it with high temperatures or chemical solutions. The removal and replacement is easily accomplished without detracting from the effective and rigid connection between the handle 101 and the paddle supporting body 102. In one embodiment, handle 101 comprises a notched end 114 adapted to be latchingly received into notched cavity 113 of paddle supporting body 102 to form the latch interface 112. Notched end 114 can be inserted into and removed from notched cavity 113 in directions 115.

Figure 6:
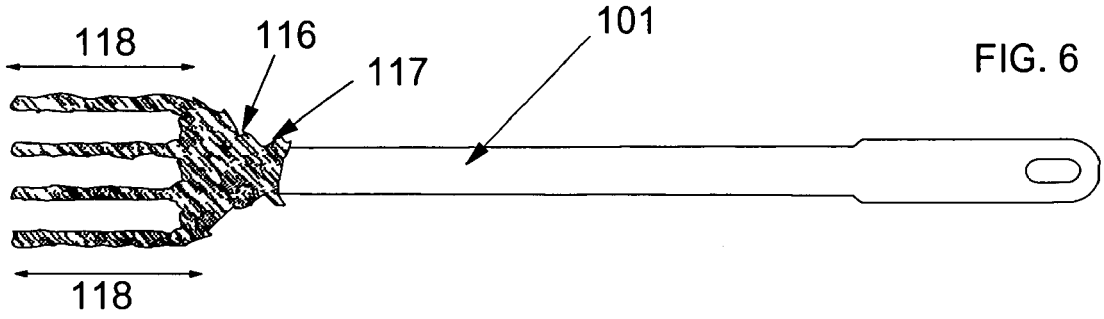
FIG. 6 is the device of FIG. 3 with an invention glove applied to the paddles and the paddle supporting body.
Figure 7:
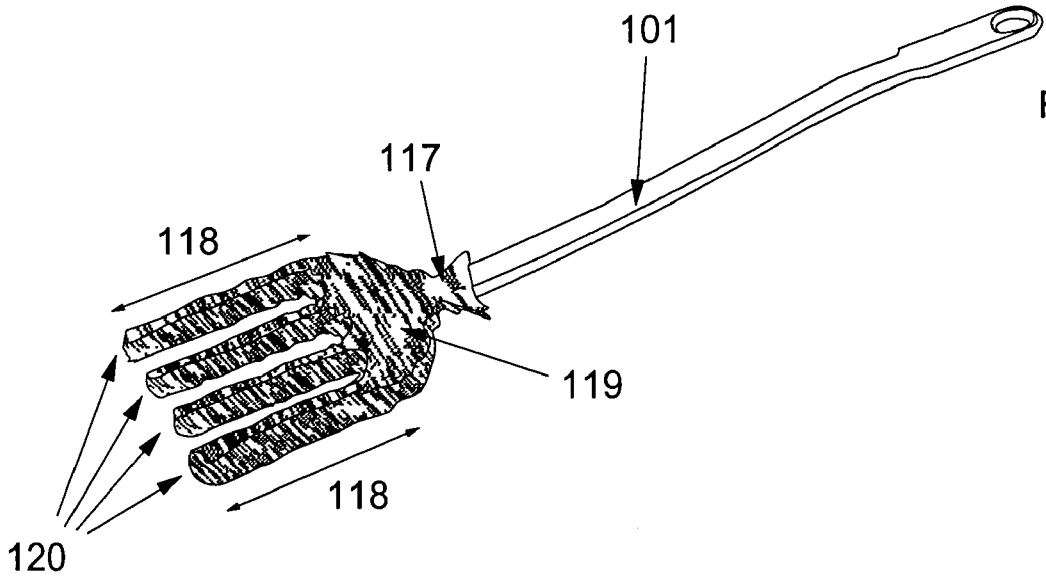
FIG. 7 is the device of FIG. 1 with an invention glove applied to the paddles and the paddle supporting body.

FIGS. 6 and 7 show device 100 with a glove 119 with fingers 120 adapted to be applied to or removed from paddles 105 and 106 in directions 118. A top neck 117 elastically or by ties is secured to the paddle supporting body 102 or to handle 101 to keep glove 119 in place during use. As described above, the material of glove 119 may be smooth or coarse on its surface, but is sufficiently non-elastic so that when device 100 is moved up and down between a user's toes, the material of glove 119 also moves up and down with the paddles to massage, clean, or apply materials to the inter-toe surfaces.

Figure 8:
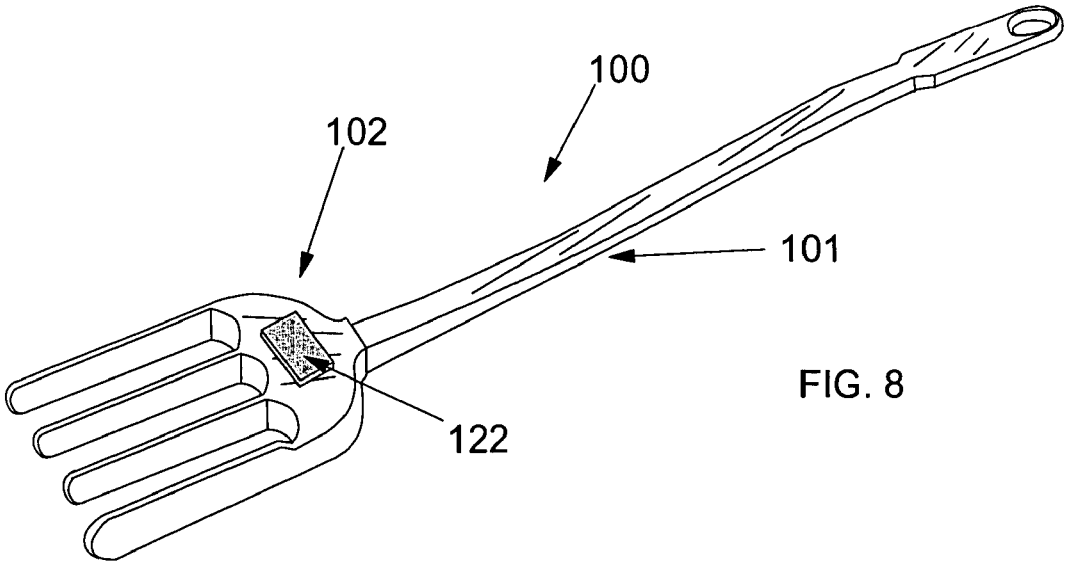
FIG. 8 is the device of FIG. 1 with an abrasive piece attached to the paddle supporting body.

FIG. 8 is the device of FIG. 1 with an abrasive piece 122 attached to the paddle supporting body 102. Abrasive piece 122 comprises an abrasive surface typical for use in smoothing toenails or removing corns or calluses. A user can use the abrasive piece 122 on a user's feet without the requirement of bending to an extreme position to reach the feet. Abrasive piece 122 may also be attached by adhesive or other means to an external surface of paddles 105 or 106, i.e., those non-opposed surfaces lateral and openly accessible to a user.

Figure 9:
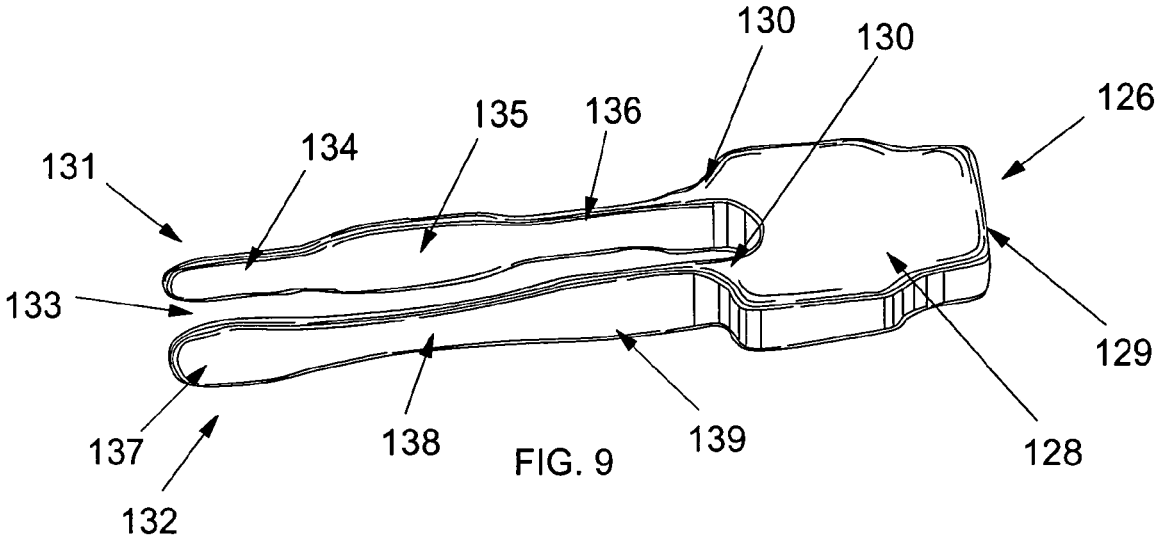
FIG. 9 is a perspective view of a variable width embodiment of the invention comprising a separable piece comprising a paddle support body and two paddle extensions with variable widths.
Figure 10:
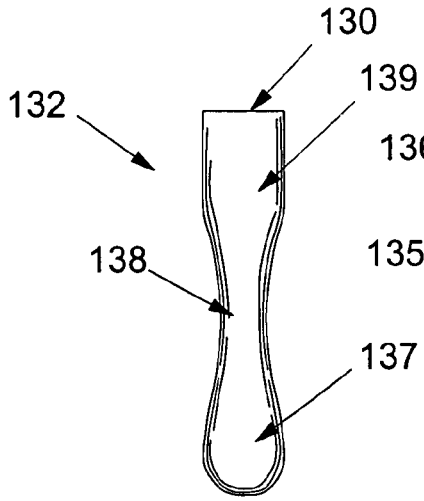
FIG. 10 is a right side view (which is similar to a left side view) of a first paddle extension broken away from the paddle support body.
Figure 11:
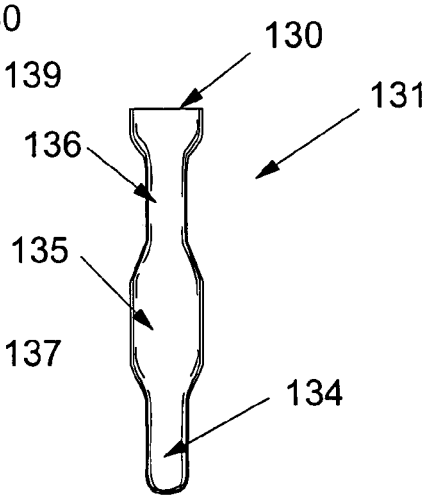
FIG. 11 is a right side view (which is similar to a left side view) of a second paddle extension broken away from the paddle support body.

FIGS. 9 through 12 show a variable width embodiment of the invention. FIG. 9 shows a perspective view of a separable piece 126 comprising a side 129 defining a notched cavity (not shown) similar to notched cavity 113 (as shown in FIGS. 3 to 5) for receiving an end of a handle for a user to releasably engage a separable piece of this embodiment. Referring again to FIG. 9, separable piece 126 further comprises two variable width paddle extensions 131 and 132. Extensions 131 and 132 extend from a proximal connection 130 to terminal ends in a parallel and spaced apart arrangement. Paddle extensions 131 and 132 are spaced apart by distance 133 in a dimension approximating a distance between inter-toe spaces in a human. Referring now to FIGS. 9, 10 and 11, paddle extensions 131 and 132 are seen to have substantially different variable width patterns.

A first paddle extension is shown as paddle extension 131 which comprises two wide width sections 137 and 139 at, respectively proximal and distal parts of the paddle extension, and separated by an intervening narrow width section 138. In contrast, A second paddle extension is shown as paddle extension 132 which comprises two narrow width sections 134 and 136 at, respectively proximal and distal parts of the paddle extension, and separated by an intervening wide width section 135. As a preferred embodiment, lengths of the paddle extensions are about 100 millimeters at a thickness of about 1.5 millimeters. Wide width sections are preferably about 20 millimeters and narrow width sections are about 10 millimeters.

FIG. 9 demonstrates clearly that separable piece 126 comprises a paddle support body 128, variable width paddle extensions 131 and 132 being rigidly fixed in a downward orientation from the paddle support body 128, said paddle extensions being located opposite a side 129 of the paddle support body 128 adapted to releasably engage a second end of a user handle, said paddle extensions 131 and 132 comprising a flattened, variable width length extending from the paddle support body 128, and said paddle extensions 131 and 132 being spaced apart by distance 133 from each other in a parallel arrangement where paddle extensions 131 and 132 are fixed to a paddle support body 128 at location 130. Further, each paddle extension 131 and 132 has about the same length, wherealong said length, moving proximal to distal to the paddle support body, the width of the paddle extension:

(1) for the first paddle extension is relatively wide in a wide width section, relatively narrow in a narrow width section, and is, at a terminal part, relatively wide in a second wide width section and (2) for a second paddle extension is relatively narrow in a narrow width section, relatively wide in a wide width section, and is, at a terminal part, relatively narrow in a second narrow width section.

Figure 12:
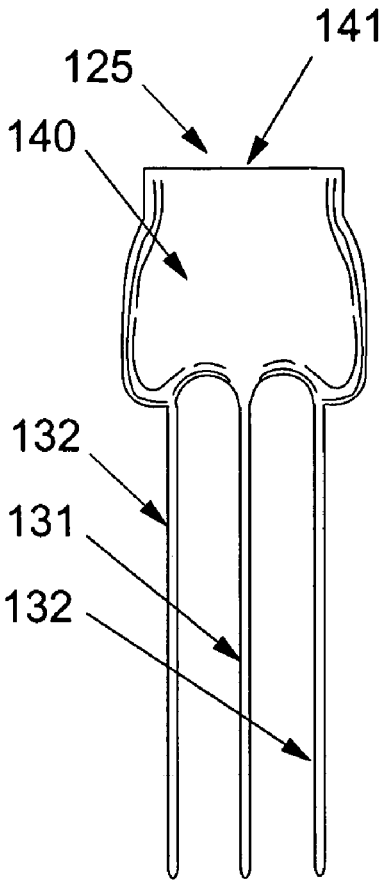
FIGS. 12, 13 and 14 are respectively front or top views of variable width embodiment pieces having, respectively, three, two and one paddle extensions.
Figure 13:
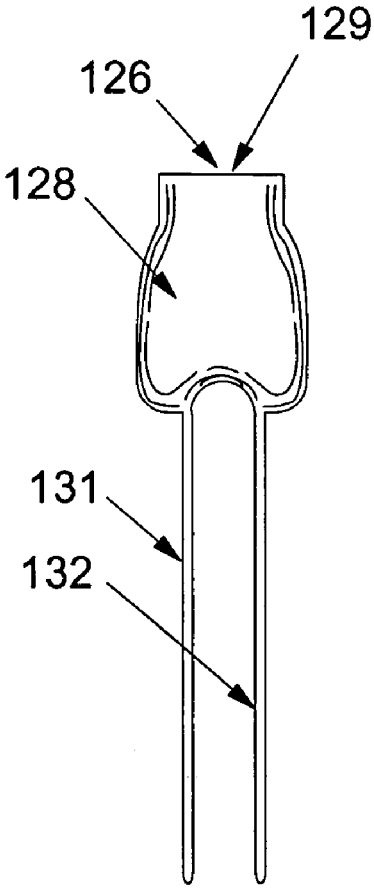
Figure 14:
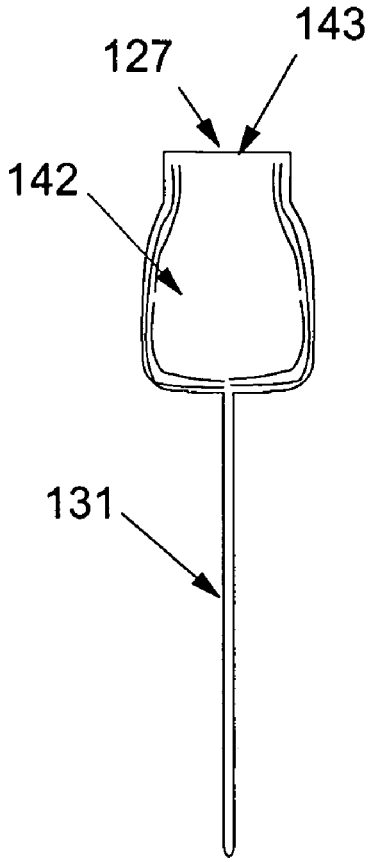

FIGS. 12, 13, and 14 show front views respectively of separable pieces 125,126 and 127, supporting, respectively 3, 2 and 1 paddle extensions as shown and described in FIG. 9.

FIG. 12 shows paddle support body 140 having a side 141 similar to side 129 of piece 126 of FIG. 9. Referring again to FIG. 12, paddle extensions 132 are adjacent to paddle extension 131, where all paddle extensions are fixed to said paddle support body in a manner similar to that shown and described for piece 126 in FIG. 9. Alternately, paddle extensions 131 may be adjacent to paddle extension 132.

FIG. 13 shows piece 126 as previously shown and described. FIG. 14 shows paddle support body 142 having a side 143 similar to side 129 of piece 126 of FIG. 9. Referring again to FIG. 14, paddle extension 131 is fixed to said paddle support body in a manner similar to that shown and described for piece 126 in FIG. 9.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A device for inter-toe massage or cleaning comprising:

(a) a handle adapted to be held by a user's hand at one end;

(b) a paddle supporting body rigidly attached to another end of the handle;

(c) four paddles having a sliding length extending parallel to each other from the paddle supporting body in a direction away from the handle;

(d) each paddle having a thickness and a width, where each width defines two leading edges adapted to permit a user to insert each of the four paddles respectively into a user's four inter-toe spaces and thereafter pull and push at the handheld end of the handle to move each paddle up and down in the inter-toe spaces;

(e) three adjacent paddles whose leading edges define two parallel planes and which each of the three adjacent paddles have equal widths; and (f) a fourth paddle has a width greater than that of the other three paddles.

2. The device of claim 1 wherein the fourth paddle has leading edges that extend beyond the two planes of the leading edges of the other three paddles.

3. The device of claim 2 wherein the fourth paddle is adapted to be inserted between a big toe and an adjacent toe of the user.

* * * * *